US006755467B1

(12) United States Patent
Chu

(10) Patent No.: US 6,755,467 B1
(45) Date of Patent: Jun. 29, 2004

(54) CONFORMABLE BACKREST FOR A CHAIR

(75) Inventor: Zooey Chu, Grand Rapids, MI (US)

(73) Assignee: Global Total Office, Downsview (CA)

( * ) Notice: Subject to any disclaimer, the term of this patent is extended or adjusted under 35 U.S.C. 154(b) by 0 days.

(21) Appl. No.: 09/597,445

(22) Filed: Jun. 20, 2000

(51) Int. Cl.[7] ..... A47C 3/25

(52) U.S. Cl. ..... 297/284.1; 297/284.4; 297/440.2

(58) Field of Search ..... 297/284.4, 452.28, 297/452.29, 230.12, 440.2, 452.63, 284.1

(56) References Cited

U.S. PATENT DOCUMENTS

| | | | | |
|---|---|---|---|---|
| 2,843,195 A | | 7/1958 | Barvaeus | |
| 3,203,734 A | * | 8/1965 | Seymer | 297/452.63 X |
| 4,810,033 A | * | 3/1989 | Kemmann | |
| 5,286,083 A | * | 2/1994 | Mattison | 297/230.12 X |
| 5,328,245 A | * | 7/1994 | Marks et al. | 297/452.29 X |
| 5,385,388 A | * | 1/1995 | Faiks et al. | |
| 5,385,389 A | | 1/1995 | Bishai | |
| 5,423,593 A | * | 6/1995 | Nagashima | 297/284.4 |
| 5,567,010 A | * | 10/1996 | Sparks | 297/284.4 X |
| 5,718,476 A | * | 2/1998 | De Pascal et al. | 297/284.4 |
| 5,752,741 A | | 5/1998 | Bort | |
| 6,013,040 A | * | 1/2000 | Morgenstern et al. | 297/284.4 X |
| 6,186,594 B1 | * | 2/2001 | Valiquette et al. | 297/284.4 X |

* cited by examiner

*Primary Examiner*—Anthony D. Barfield
(74) *Attorney, Agent, or Firm*—Michael Best & Friedrich LLP

(57) ABSTRACT

A backrest for use with a chair includes a support structure. The support structure has a rigid outer rim and flexible inner back support section. The support section consist of a number of generally parallel slats (vertically extending members) which seperately support parallel longitudinal sections of the person's back. Each slat produces a force against the person's back responsive to the weight placed on the slat by the person's back. As the person shifts positions, each slat moves to dynamically provide an increased or decreased force against the person's back, depending on whether the person is applying an increased or decreased force against the slat.

18 Claims, 7 Drawing Sheets

CONFORMABLE BACKREST FOR A CHAIR

FIELD OF THE INVENTION

This invention relates to backrests for chairs. More particularly, the invention relates to a backrest that provides adjustable support to the lumbar region of the back of a user seated on a chair.

BACKGROUND OF THE INVENTION

Backrests that provide lumbar support are known. The majority of these backrests have a non-adjustable lumbar support. The lumbar support is built into the back rest and is therefore configured to provide adequate support for a typical person. In practice, such backrests provide inadequate support for people who are larger or smaller than average. Adjustable lumbar supports are also known, however, these devices tend to have complex adjustment mechanisms that are both heavy and costly.

For example, Kemmann describes an adjustable backrest in U.S. Pat. No. 4,810,033. This backrest has an outer frame that holds a deformable plate that provides lumbar support. The top portion of the plate (i.e. the region of the plate nearer the upper back of a user) is formed into a series of longitudinal slats, running from the top of the lumbar support to its centre. The lower portion of the lumbar support plate (i.e. the portion which actually supports the user's back) does not have any openings and is less flexible. A control knob is drivingly connected to the plate through a complex mechanism and is rotatably mounted to change the position of the lower portion of the plate to force the plate outwardly to whereby the plate provides lumbar support.

One disadvantage of lumbar adjustment mechanisms is that they utilize complex and costly adjustment mechanisms. Therefore, they tend to be provided on more expensive chairs. Thus they may be provided on chairs for executives and professionals but not an secretarial chairs who would also benefit from a more ergonomic chair. Further, due to the complexity of the mechanism, the mechanism is prone to breaking.

SUMMARY OF THE INVENTION

In accordance with one aspect of the instant invention, there is provided a backrest for supporting a person's back having a front surface and a rear surface, the backrest comprising a flexible support section having a fixed end which is mounted to a support structure and a free end which is displaceable vertically with respect to the fixed end, the support section is configured to be compressed and displaced forwardly when the free end is moved towards the fixed end; an adjustment member drivingly connected to the free end; and a detent member for selectively receiving the adjustment member in one of a plurality of positions, the support member biasing the adjustment member into retaining engagement with the detent member due to the compression of the flexible support member by the displacement of the free end towards the fixed end. This provides a simple, reliable mechanical adjustment member for a back rest of a chair and, preferably for the lumbar support member of a back rest.

In one embodiment, the support structure comprises a frame and a shell mounted on the frame and the support section is provided as part of the shell.

In another embodiment, the frame has an opening sized to receive therein the support section.

In another embodiment, the support member comprises a plurality of slats extending vertically between the fixed end and the free end of the support section.

In another embodiment, the slats extend from a position adjacent the fixed end to a position adjacent the free end.

In another embodiment, the shell comprises a perimeter section surrounding a central section in which the support structure is provided and, when mounted on a chair, the support structure has a vertical extent sufficient to support at least the lumbar region of the person when seated in the chair.

In another embodiment, the shell has first engagement members and the frame has second engagement members configured to engage the first engagement members whereby the engagement of the first and second engagement members retains the shell on the frame.

In another embodiment, one of the first engagement members and the second engagement members comprise a plurality of openings and the other of the first and second engagement members comprises projecting members that are locking received in the openings.

In another embodiment, the fixed end comprises the upper end and the free end comprises the lower end and the detent member comprise a plurality of vertically spaced apart members each of which has a downwardly extending recess and the adjustment member is sized to be received in each recess.

In another embodiment, the detent member comprises a plurality of vertically spaced apart members each of which has a recess to receive therein the adjustment member and support member biases the adjustment member into engagement with the recesses.

In another embodiment, the frame has a front face and a vertically extending opening adjacent the free end, the shell is mounted on the front face, the adjustment member is mounted at the free end of the support structure and has a handle which extends through the vertically extending opening whereby the support structure may be actuated from the rear of the backrest.

In accordance with another aspect of the instant invention, there is provided a backrest for supporting a user's back having a front surface and a rear surface, the backrest comprising a frame; a shell mounted on the frame, the shell having a flexible support section; and first engagement members provided an the shell and second engagement members provided on the frame, the second engagement members are configured to engage the first engagement members whereby the engagement of the first and second engagement members retains the shell on the frame. This construction provides a simple and easily manufacturable flexible back rest for a chair.

In accordance with another aspect of the instant invention, there is provided a backrest a backrest for supporting a user's back having a front surface and a rear surface, the backrest comprising a shell having a perimeter section surrounding a central section and a plurality of slats extending vertically between the perimeter to occupy the central section and, when mounted on a chair, the slats have a vertical extent sufficient to support at least the lumbar and mid back regions of the person when seated in the chair; a frame having an opening sized to receive therein the slats; and mounting members to mount the shell on the frame. This construction provides a simple and easily manufacturable flexible back rest for a chair.

BRIEF DESCRIPTION OF THE DRAWINGS

The present invention will now be explained, by way of example only, with reference to the drawings in which.

DETAILED DESCRIPTION OF THE PREFERRED EMBODIMENT

Figure 2:
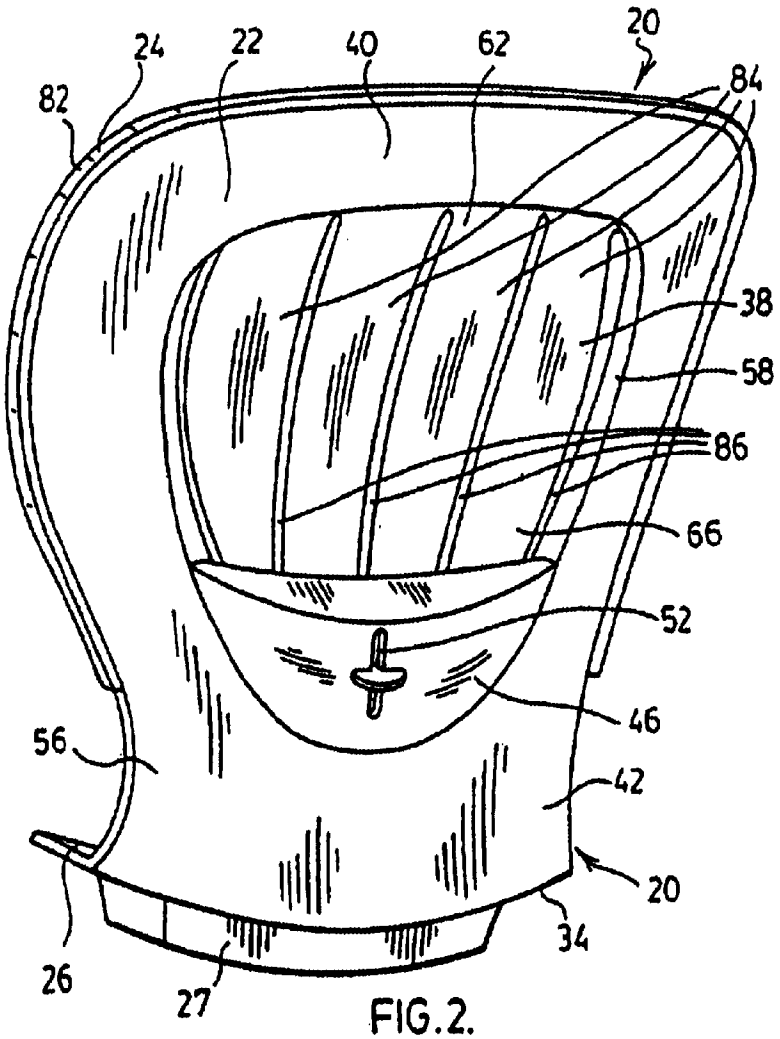
FIG. 2 is a rear perspective view of the backrest of FIG. 1.
Figure 1:
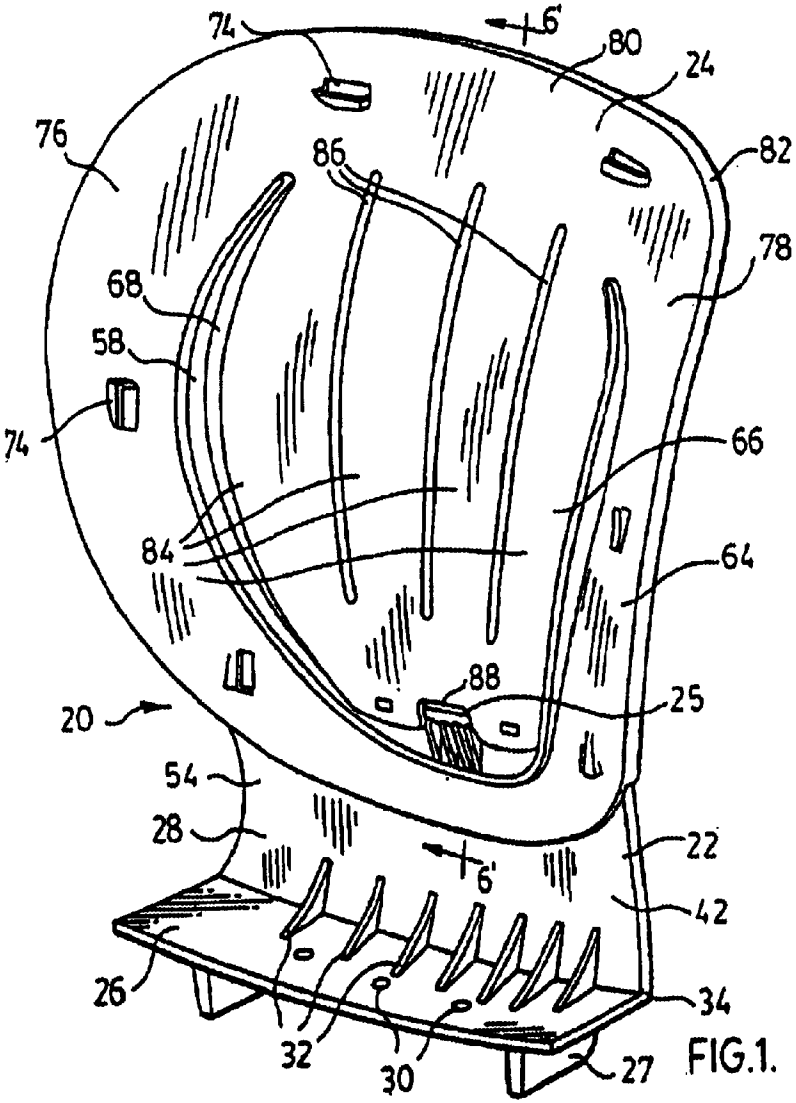
FIG. 1 is a front perspective view of a first embodiment of a backrest according to the present invention.

Reference is first made to, FIGS. 1 and 2, which show an exemplary backrest 20 made according to the present invention. Backrest 20 is comprised of a frame 22 (see FIG. 3) a support shell 24 (see FIG. 4), a lever 25 (see FIG. 5) and is adapted to be mounted to a chair having a seat.

Figure 3:
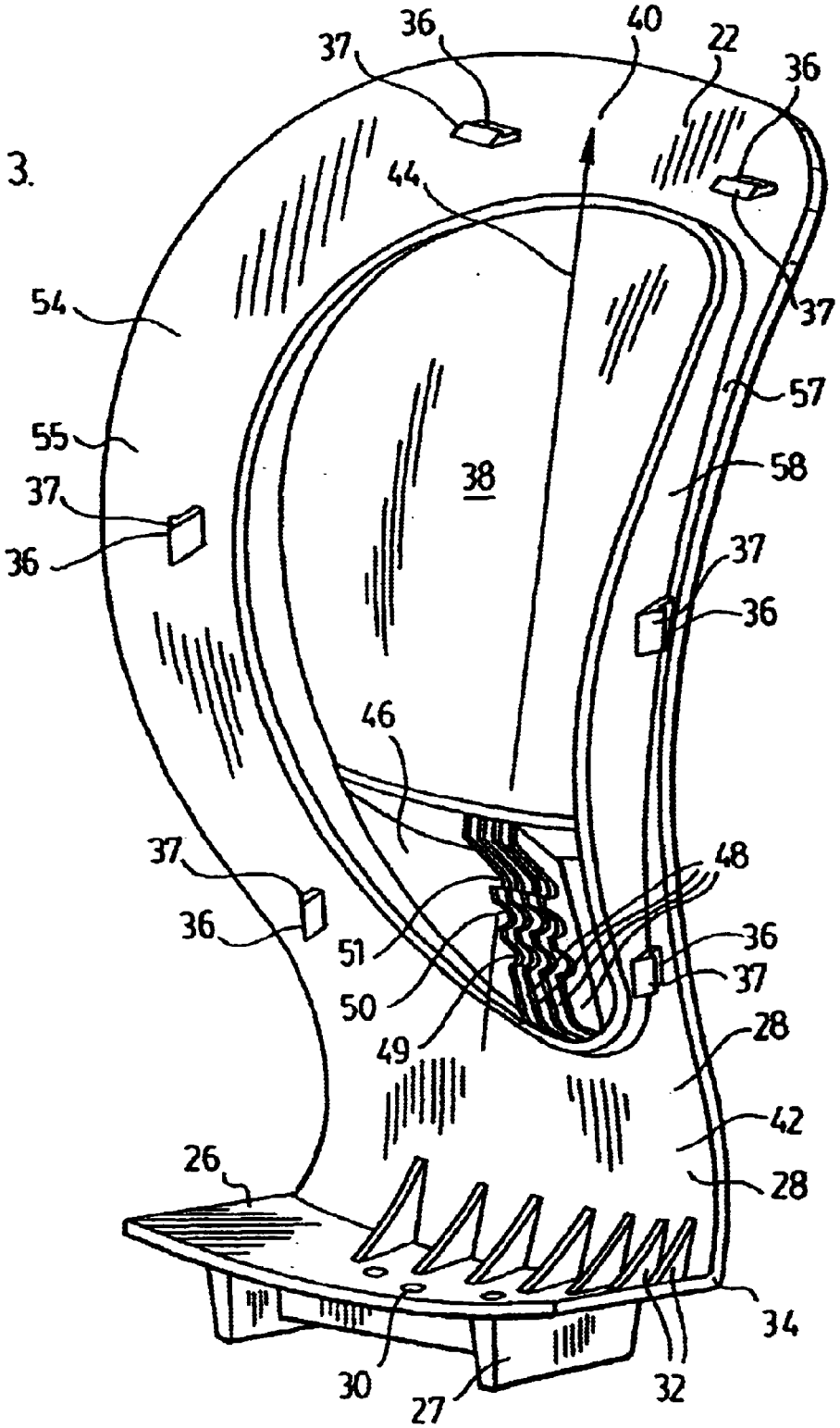
FIG. 3 is a front perspective view of the frame of the backrest of FIG. 1 without the lumbar support shell.

Frame 22 may be of any particular shape that provides a mount for receiving support shell 24. As shown in FIGS. 1, 2, and 3, frame 22 has a top 40, a bottom 42, and opposed front and rear sides 54 and 56. Top 40 and bottom 42 define a longitudinal or vertical axis 44 and the outer perimeter of frame 22. Preferably, backrest 20 is covered with padding (eg. foam) and a covering (eg. cloth or leather). As such, except for the added dimension contributed by the padding, the outer perimeter of backrest 20 is substantially the same as that of frame 22.

Frame 22 may be mounted to the chair by any means known in the art. Thus backrest 20 may be mounted to the seat support of the chair or to the seat itself. In the embodiment shown in FIGS. 1, 2 and 3, frame 22 has a mounting section 26 at its bottom which may be mounted either to a seat support of a chair or to a seat itself. Base section 28 extends between mounting section 26 at top 40. Mounting section 26 and base section 28 meet at corner 34. Mounting section 26 has a number of mounting holes 30 that may be used to mount frame 22 onto a seat or base of a chair (not shown). Optionally, mounting section 26 has a U-shaped reinforcing ridge 27 extending from its bottom. Reinforcing ridge 27 increases the rigidity of mounting section 26 so that it will not substantially flex during use. Mounting section 26 and base section 28 are preferably connected by a number of ribs 32. Ribs 32 provide increased strength at corner 34 so as to ensure that mounting section 26 and base section 28 are not easily pulled apart at corner 34.

Figure 4:
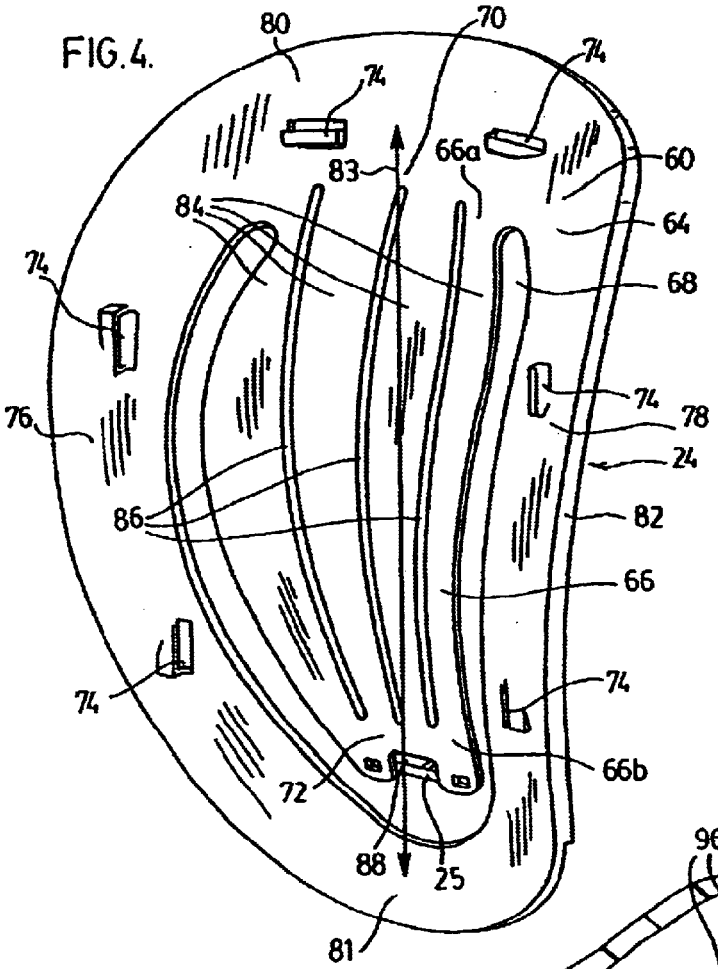
FIG. 4 is a front perspective view of a lumbar support shell of the backrest of FIG. 1.

In one preferred embodiment, support shell 24 is adapted to be mounted on frame 22 and to provide a mount for flexible support section 66. Accordingly, support shell 24 may be of any particular shape which is sized to be received on frame 22. As shown in FIG. 4, support shell 24 has a top 80, a bottom 81, a front side 60, a rear side 62, left side 76 and a right side 78. Top 80 and bottom 81 define a longitudinal axis 83, which is parallel to the longitudinal axis 44 of frame 22, when support shell 24 is mounted on frame 22.

Flexible support section 66 may be of any configuration which will bow outwardly when compressed to provide variable support to a person seated in a chair to which backrest 20 is affixed. When at least one of the upper and lower ends of flexible support section 66 is displaced towards the other, flexible support section 66 is compressed and bows outwardly (frontwardly) to provide support (or an additional amount of support) to a person seated in the chair. To permit the discrete adjustments of the amount of support provided by flexible support section 66, frame 22 is provided with at least one detent member (eg. support rib 48) for releasably receiving at least one abutment member which is drivingly connected to flexible support section 66 to compress flexible support section 66. Preferably, detent members have an upper surface for receiving therein the abutment member. Flexible support section may be positioned so that when backrest 20 is mounted on a chair, it provides lumbar support to a person seated in the chair. However, this arrangement may be used to provide flexible support to other portions of the back of a person and in one embodiment, provides support to the lumbar and mid back of a person.

In one aspect of this invention there is provided a flexible support section 66 which is not adjustable to vary the amount of support provided. In such a case, flexible support structure extends vertically from one opposed side of perimeter 64 to the other opposed side of perimeter 64. In such an embodiment, the advantages of the simplified construction of the flexible back rest this design is still obtained.

In another aspect of this invention, flexible support structure advantageously utilizes the simple adjustment mechanism of this design to allow the amount of support to be varied. In this embodiment, flexible support section 66 has a fixed end 70 and a free end 72. Fixed end 70 is joined to rim 64, while free end 72 is independently moved longitudinally toward or away from fixed end 70. In such an embodiment, it will be appreciated that support shell 24 and frame 22 may be integrally moulded as a unit. In such a case the integral unit comprises a support structure for the flexible support section. Regardless of the mechanism used, frame 22 and shell 24 define a one piece assembly and provide a support for slats 84 so that free end 72 of slats 84 may be moved along axis 83 whereby the compression of slats 84 biases the adjustment member (eg. rod 90) into the detent member (eg. notch or recesses 49, 50, 51).

In the preferred embodiment shown in FIGS. 1, 3 and 4, a two piece construction is used and support shell 24 may be mounted to frame 22 by any means known in the art. Accordingly, support shell 24 and frame 22 may be releasably mounted together by releasable male and female engagement members. Alternately, support shell 24 and frame 22 may be permanently connected together by mechanical means (eg. screws or rivets) or by chemical means (eg. an adhesive of spot welding) or by the non-releasable interengagement of elements.

In the embodiment of FIG. 3, shell 24 and frame 22 are assembled together by first and second engagement members that are preferably male and female engagement members 36 and 74. Male engagement members 36 comprise a plurality of mounting tabs spaced around the periphery of an opening 38 (see FIG. 3). Each mounting tab 36 has a hook 37. Female engagement members 74 comprises a plurality of mounting slots which are positioned to receivably engage mounting tabs 36.

As shown in FIG. 4, rim 64 has a plurality of mounting slots 74 which are aligned with mounting tabs 36 of frame 22. Support shell 24 is mounted on frame 22 by inserting mounting tabs 36 through mounting slots 74. The hook 37 of each mounting tab 36 catches one side of the corresponding mounting slot 74 and thereby holds support shell 24 fixedly on the front surface of frame 22.

Support shell 24 is preferably sized such that rim 64 extends slightly outwardly of the edge of frame 22 along its left side 76, its right side 78 and its top 80. A lip 82 is formed along left side 76, right side 78 and top 80 of support shell 24. A lip 82 which extends rearwardly from the surface of support shell 24 is preferably provided to add rigidity to rim 64.

Flexible support section 66 may be a thin plastic plate. In either embodiment, flexible support section 66 is preferably divided into a plurality of slats 84 by longitudinal slots 86. In the preferred embodiment shown in the Figures, there are three slots 86 providing four slats 84 however, more or less slats may be provided. If flexible support member is not adjustable, then slats 84 preferably extend from the top of shell 24 to the bottom of shell 24. If flexible support member is adjustable, then slats 84 preferably extend from the top of shell 24 towards the bottom of shell 24. For example, support shell 24 may have an outer rim or perimeter 64 and a flexible support section 66 is provided centrally therein and is are separated by a generally U-shaped slot 68. U-shaped slot 68 may be shaped to conform with reinforcing wall 58 of frame 22, so that when support shell 24 is mounted on frame 22, reinforcing wall 58 extends through slot 68.

The amount of support provided by flexible support member 66 is preferably varied by an adjustment member which is drivingly connected to free end 72 and a detent member for selectively receiving the adjustment member in one of a plurality of positions, flexible support member 66 biasing the adjustment member into retaining engagement with the detent member due to the compression of flexible support member 66 by the displacement of the free end 72 towards the fixed end 70. Preferably, the detent member comprise a plurality of vertically spaced apart members each of which has a downwardly extending recess and the adjustment member is sized to be received in each recess. Preferably, the detent member comprises a plurality of support ribs 48 on the front side of web 46. Each support rib 48 has a lower notch 49 a middle notch 50 and an upper notch 51, which are vertically spaced apart. The lower notches 49 of all the support ribs 48 are aligned. Similarly, the middle notches 50 are aligned and the upper notches 51 are aligned. At the bottom centre of free end 72, a cavity 88 is provided. Cavity 88 is aligned with support ribs 48 when support shell 24 is mounted on frame 22 and is made wide enough to allow all of the support ribs 48 to pass through it.

In the preferred embodiment of backrest 20, base section 28 has four support ribs 48 each of which has three notches 49, 50 and 51. In a different embodiment of a backrest according to the present invention, a different number of support ribs, having a different number of notches, may be provided. Web 46 has a longitudinal slot 52 centred between the two central support ribs 48. Slot 52 extends below the lower notch 49 and above the upper notch 51 in each of support ribs 48. Optionally a reinforcing wall 58 surrounds opening 38 and web 46 on the front side of frame 22. Reinforcing wall 58 provides rigid support to frame 22 to reduce its flexibility when backrest 20 is in use.

Figure 5:
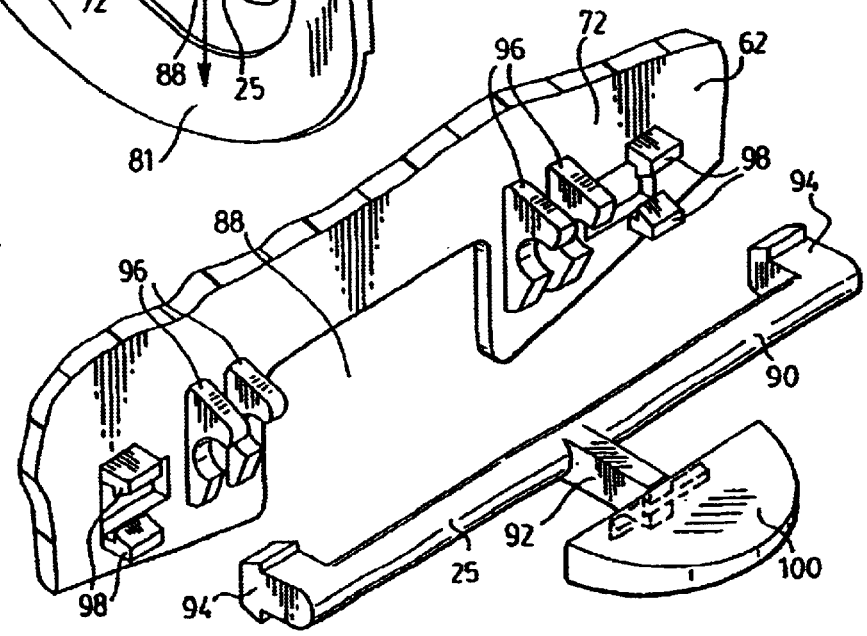
FIG. 5 is an enlarged exploded view of the lever and a handle of the backrest of FIG. 1.

FIG. 5 which shows the adjustment member 25 positioned adjacent the free end 72 of flexible support section 66 from rear side 62. Adjustment member 25 utilizes a rod which is removably receivable into downwardly extending notches 49, 50 and 51. Notches need not be sized to lockingly receive rod 90 since due to the compression of flexible support section 66, rod 90 is biased downwardly into the notch with which it is aligned.

Preferably, rod 90 is removably mounted to free end 72 by engagement members. Accordingly, adjustment member 25 may also comprise an arm 92 and a pair of hooks 94 (male engagement members). Flexible support section 66 has a pair of mounting clamps 96 a pair of opposed mounting tabs 98 on each side of cavity 88. Mounting clamps 96 cooperate with rod 90 and mounting tabs 98 (female engagement members) cooperate with hooks 94 to hold adjustment member 25 in a fixed position at the bottom rear side of flexible support section 66. Hooks 94 are inserted into tabs 98 and rod 90 is inserted into clamps 96. Tabs 98 and hooks 94 cooperate to prevent adjustment member 25 from being pulled from flexible support section 66 by a rearward force. Clamps 96 and rod 90 prevent adjustment member 25 from twisting upward or downward when adjustment member 25 is moved during the use of backrest 20. Arm 92 extends rearwardly from the centre of rod 90. As shown in FIG. 2, arm 92 extends through slot 52 in frame 22. A handle 100 is affixed to the end of arm 92.

Figure 6:
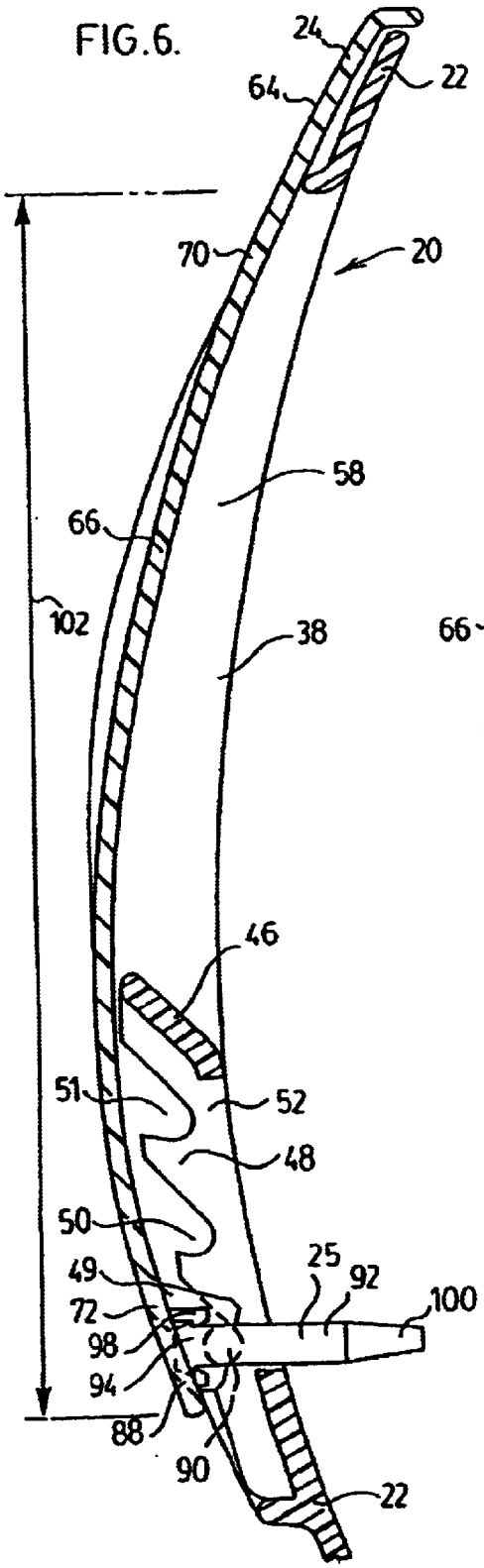
FIG. 6 is a sectional view along the line 6'—6' of the backrest of FIG. 1 in a first position.

Frame 22 and support shell 24 may be manufactured from plastic or another material. Preferably, frame 22 is substantially rigid so that it will not flex when backrest 20 is in use. Reinforcing wall 58 optionally provides rigidity to frame 22. Similarly, optional rim 64 of support shell 24 is preferably substantially rigid and lip 82 provides rigidity for rim 64. As noted above, optional reinforcing ridge 27 provides rigidity to mounting section 26. Flexible support section 66, however, is preferably flexible so that when free end 72 is moved closer to or further away from fixed end 70, flexible support section 66 flexes to become more or less convex, as viewed from the front side 60 of support shell 24 (FIGS. 6 and 7).

The adjustment of back rest 20 to provide differing levels of lumber support will now be explained with reference to FIGS. 6 and 7. FIG. 6 shows backrest 20 configured to provide a relatively low level of lumbar support. FIG. 7 shows backrest 20 configured to provide an increased level of lumbar support. Referring to FIG. 6, rod 90 of adjustment member 25 (which is fixedly attached to the bottom rear side of flexible support section 66) is positioned in notch 49. Rod 90 of adjustment member 25 is positioned in notch 49. The distance between the top of fixed end 70 and the bottom of free end 72 of flexible support section 66 is distance 102. Flexible support section 66 appears convex when viewed from the front of backrest 20.

To increase the degree of lumbar support provided by backrest 20, and more particularly by flexible support section 66, a user may grasp handle 100 and lift adjustment member 25 from notch 49 and place it in notch 50 or notch 51. In order to do this, the user must first simultaneously move adjustment member 25 forward and upward, then lift adjustment member 25 to the appropriate height depending on the notch 50 or 51 in which arm 90 is to be inserted and then pull adjustment member 25 back to seat arm 90 in the selected notch. Since adjustment member 25 is fixedly attached to the bottom rear side of flexible support section 66, moving adjustment member 25 from notch 49 to notch 50 or notch 51 will decrease the distance between fixed end 70 and free end 72 of flexible support section 66.

Figure 7:
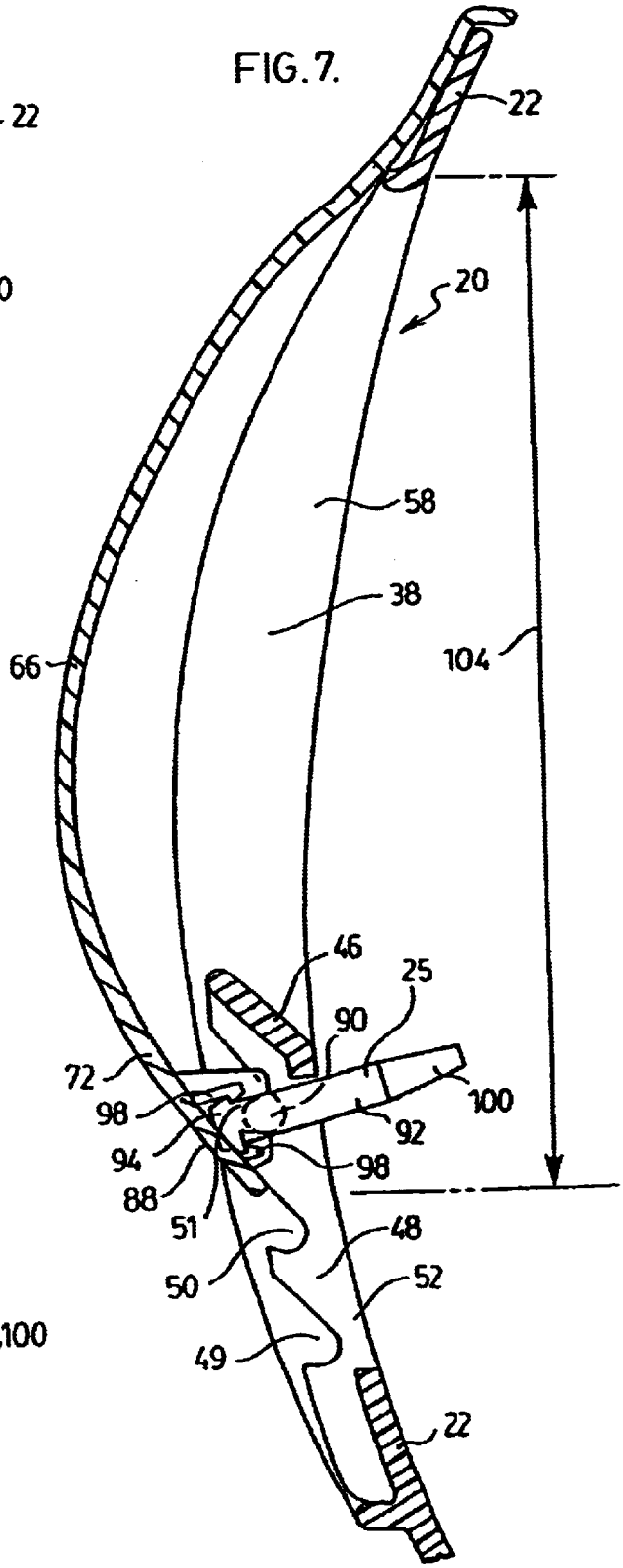
FIG. 7 is a sectional view along the line 6'—6' of the backrest of FIG. 1 in a second position.

FIG. 7 shows arm 90 of adjustment member 25 positioned in notch 51. The distance between the top of fixed end 70 and the bottom of free end 72 is distance 104. Distance 104 is substantially less than distance 102. As a result, the convexity of flexible support section 66 when viewed from the front of backrest 20 has been increased. A user seated on the chair to which backrest 20 has been attached will receive greater lumbar support from flexible support section 66, when it is configured as shown in FIG. 7 than when it is configured as shown in FIG. 6.

A user may return backrest 20 to the configuration of FIG. 6 by grasping handle 100 and moving adjustment member 25 such that arm 90 is released from notch 51 and then lowering adjustment member 25 and then positioning arm 90 in notch 49. Alternatively, the user may position arm 90 in notch 50 which will cause flexible support section 66 to have a degree of convexity intermediate that shown in FIGS. 6 and 7 and will provide an intermediate level of lumbar support.

In this way, backrest 20 provides a simple mechanism for adjusting the degree of lumbar support provided by backrest 20. Flexible support section 66 is configured such that it will bias its free end 72 downward at all times. Accordingly, when arm 90 of adjustment member 25 is inserted into any one of notches 49, 50 or 51, flexible support section 66 will apply a downward force to hold arm 90 in the selected notch.

In use, the front side of backrest 20 is normally be covered by a padding material and a fabric cover (not shown). A user, therefore, does not normally lean directly against backrest 20 or flexible support section 66, but does so through the cover and the padding material.

Figure 8:
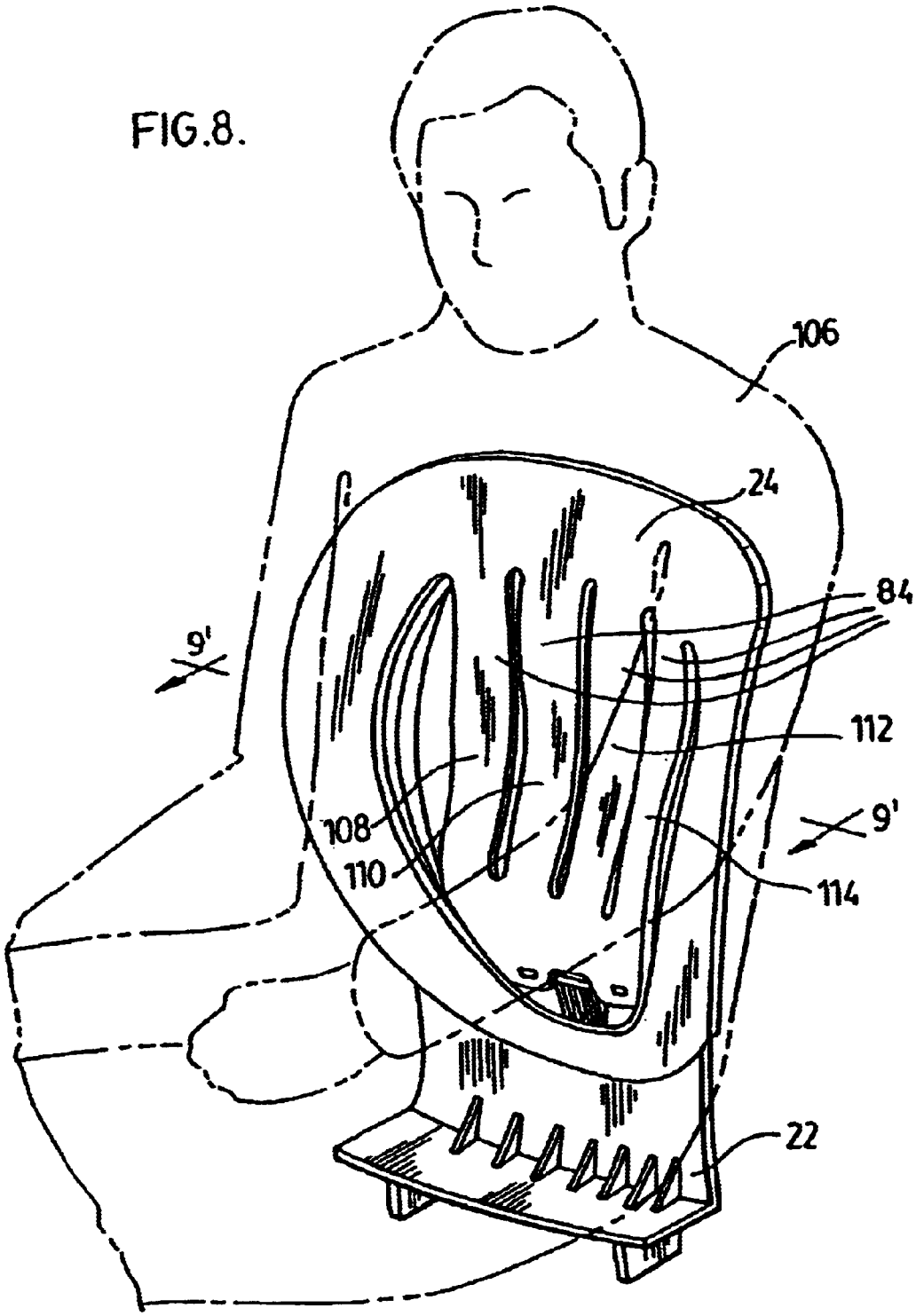
FIG. 8 is a perspective view of the backrest of FIG. 1 when in use by a person.

Reference is next made to FIG. 8 which illustrates the operation of backrest 20 when in use by a person 106. When a person 106 leans against backrest 120 and particularly against flexible support section 66, slats 84 of flexible support section 66 will be deformed in rearwardly. Each slat 84 independently supports a different longitudinal portion of the user's back in general. As a result, a user with a wider back will cause outer slats 108 and 114 to be deformed more than would a user with a narrower back. A user with a narrower back will receive a greater proportion of lumbar support from the inner slats 110 and 112. Since slats 84 flex independently of one another, flexible support section 66 conforms to the actual shape of a particular user's back and conforms to different users who may use backrest 20 at different times, without requiring adjustment.

Figure 9:
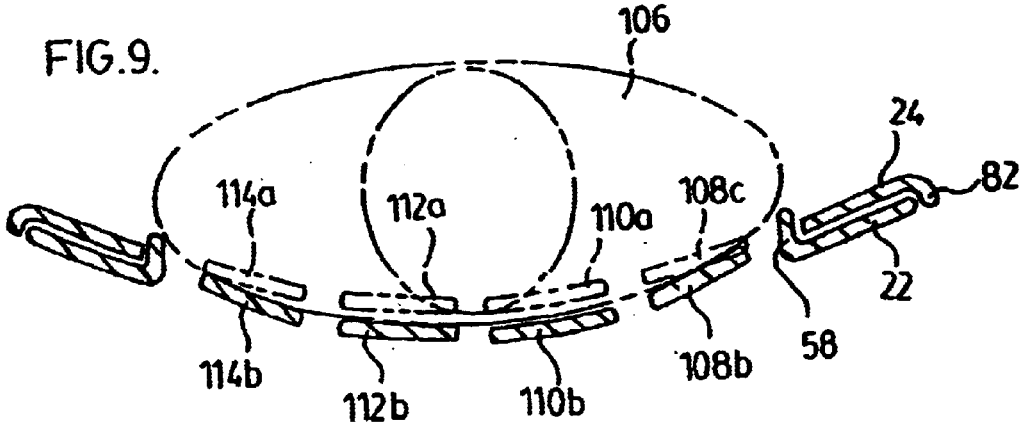
FIG. 9 is a sectional view along the line 9—9 of the backrest of FIG. 1 illustrating the flexing of the lumbar support shell when a person is seated upright in the chair.

Reference is made to FIG. 9. The position of slats 108, 110, 112 and 114 when backrest 20 is not in use is shown at 108*a*, 110*a*, 112*a* and 114*a*, respectively, in dotted outline. The position of slats 108, 110, 112, and 114 when a typical person is leaning against backrest 20 is shown at 108*b*, 110*b*, 112*b* and 114*b*, respectively, in solid outline. When person 106 leans against backrest 20, slats 108, 110, 112 and 114 are deformed from positions 108*a*, 110*a*, 112*a* and 114*a* to positions 108*b*, 110*b*, 112*b* and 114*b*. The deformation of each slat 108, 110, 112, and 114 will depend on the weight applied by person 106 to that particular slat.

Figure 10:
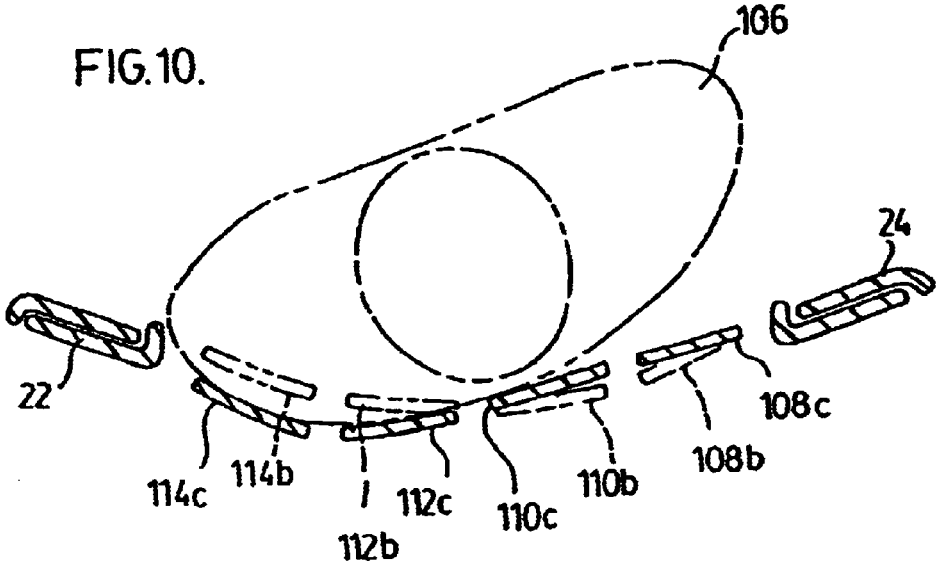
FIG. 10 is a sectional view along the line 9—9 of the backrest of FIG. 1 illustrating the flexing of the lumbar support shell when the person using it turns to one side.

Reference is next made to FIG. 10. The positions 108*b*, 110*b*, 112*b* and 114*b* of slats 108, 110, 112 and 114, respectively, when person 106 is leaning against backrest 20, as in FIG. 9, is shown in dotted outline. When person 106 turns to one side, slate 108, 110, 112 and 114 move to positions 108*c*, 110*c*, 112*c* and 114*c*, shown in solid outline. Slats 112 and 114 have deformed further backwards while allowing slat 110 to move somewhat forward and allowing slat 108 to return entirely to its unused position 108*a*.

FIGS. 8, 9 and 10 illustrate how the independent flexibility of slats 108, 110, 112 and 114 allows flexible support section 66 to reactively provide differing degrees of support to differing longitudinal portions of a user's back, depending not only on the size and shape of the user's back but also on the position in which the user is seated at any particular time. Accordingly, by using a flexible support section 66 comprising a plurality of independently movable slats 84 a back rest support is provided that will not only conform to the shape of the back of a user but will also conform to the position of the back of a user as the user moves in the chair.

Figure 12:
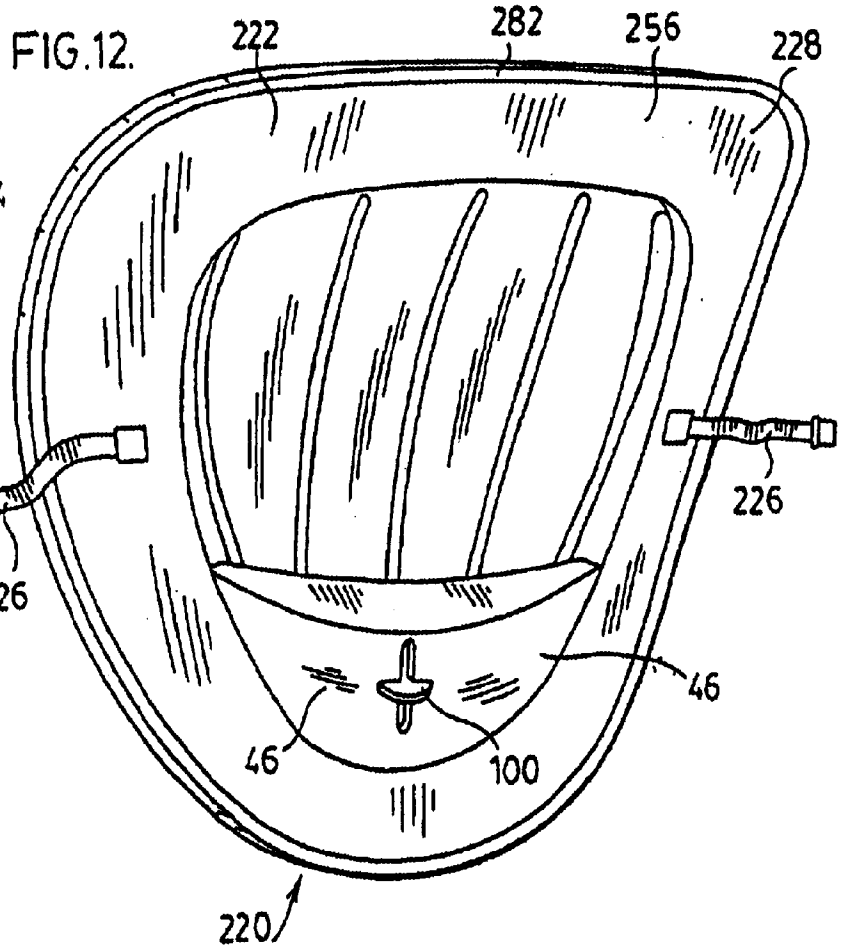
Figure 11:
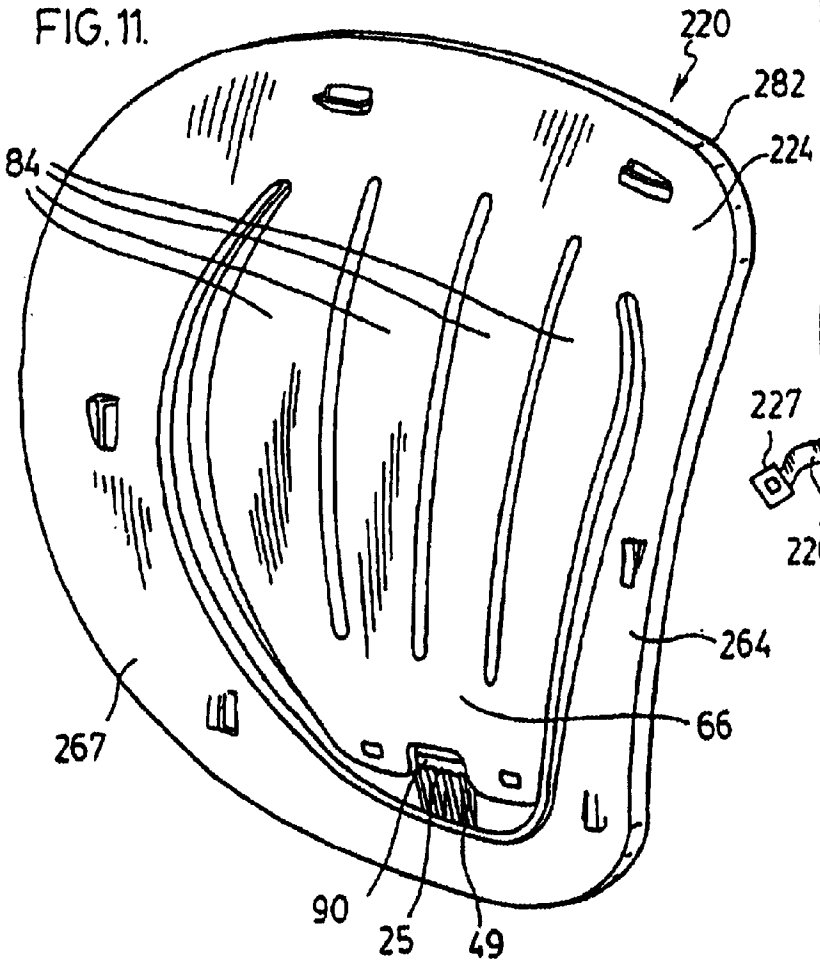
FIG. 11 is a front perspective view of a second embodiment of a backrest according to the present invention; and, FIG. 12 is a rear perspective view of the backrest of FIG. 11.

Reference is next made to FIGS. 11 and 12, which illustrate a second exemplary backrest 220 made according to the present invention. Backrest 220 comprises of a frame 222, a support shell 224 and an adjustment member 25. Backrest 220 is similar to backrest 20 in structure and operation, except that back rest 220 is designed for portable use with different chairs, rather than for mounting on a single chair. Components of backrest 220 which are identical to corresponding components of backrest 20 are identified by the same reference numerals.

Frame 222 has a base section 228, but does not have a mounting section. Instead, backrest 220 has a pair of mounting straps 226 affixed to the rear side 256 of frame 222. Straps 226 may be provided with buckles 227 and may be used to attach backrest 222 in front of the backrest of a typical chair (not shown), thereby adding the functionality of backrest 222 to the chair.

Rim 264 of support shell 224 extends beyond the perimeter of base section 228 on all sides. A lip 282 is formed around the perimeter of rim 264 to provide rigidity to rim 264.

Backrest 220 is adjusted to provide differing levels of lumbar support in exactly the same manner as described above for backrest 20. Depending on the construction of the chair (not shown) to which backrest 220 is attached, it may be necessary to adjust backrest 220 by positioning rod 90 in the appropriate notch 49, 50 or 51 (notches 50 and 51 not shown in FIGS. 11 and 12) prior to affixing backrest 220 on the chair (i.e. if the backrest of the chair would obstruct handle 100).

Backrest 20 and backrest 220 have been described as providing lumbar region of a user's back. Depending on the vertical contour of the support section of the backrest, support may be provided to lumbar, medial and upper regions of the back simultaneously. Such an embodiment of a backrest according to the present invention may support both the vertically central section of the user's back (along the spine) and the lateral sides (i.e. the left and right sides) of the user's back.

These and other variations of a backrest according to the present invention will be within the competence of a person skilled in the art. All such variations fall within the scope of the invention, which is limited only by the following claims.

I claim:

1. A backrest for attachment to a chair having a seat, the backrest having a front and a back and comprising:

(a) a frame having a top and a bottom and comprising an outer peripheral portion which surrounds a central open portion;

(b) a support shell mounted on the frame; and, (c) a plurality of flexible, independently moveable, vertically extending members mounted to said support shell and positioned to engage at least a portion of a back of a person when the person is seated in the chair, whereby the support shell and the vertically extending members are formed integrally, the vertically extending members are positioned in the central open portion when the backrest is assembled and the vertically extending members engage the frame only at the top and the bottom whereby the vertically extending members support the back of the person without engaging any structural member positioned behind the vertically extending members.

2. The backrest of claim 1 wherein the vertically extending members are positioned to engage at least the lumbar and mid-back of the person when the person is seated in the chair.

3. The backrest of claim 1 wherein the vertically extending members are positioned to engage substantially the entirety of the portion of the back of the person which is supported by the back rest.

4. The backrest of claim 1 wherein the flexion of the vertically extending members conforms to the shape of the back of the person as the position of the back of the person with respect to the backrest is adjusted.

5. The backrest of claim 1 wherein the support shell and the frame each have an outer peripheral portion and a central opening and the vertically extending members are positioned in the central openings.

6. The backrest of claim 1 wherein the vertically extending members have a bottom portion that is vertically adjustable.

7. A backrest for attachment to a chair having a seat, the backrest comprising:

(a) a support structure having a top and a bottom and a central open portion; and, a plurality of flexible, independently moveable, vertically extending members positioned in the central open portion to engage at least a portion of a back of a person when the person is seated in the chair, the vertically extending members have a front face, a rear face, a forward extent of movement and a rearward extent of movement wherein at the forward extent of movement the front face of the vertically extending members is spaced from any other structural member of the backrest and at the rearward extent of movement the rear face of the vertically extending members is spaced from any other structural member of the backrest, wherein the vertically extending members have a bottom portion that is vertically adjustable.

8. The backrest of claim 7 wherein the bottom portion is engagable at a plurality of vertically spaced apart engagement members provided on a bottom portion of the back rest.

9. The backrest of claim 7 wherein the vertically extending members are positioned to engage at least the lumbar and mid-back of the person when the person is seated in the chair.

10. The backrest of claim 7 wherein the vertically extending members are positioned to engage substantially the entirety of the portion of the back of the person which is supported by the back rest.

11. The backrest of claim 7 wherein the flexion of the vertically extending members conforms to the shape of the back of the person as the position of the person with respect to the backrest is adjusted.

12. A backrest for attachment to a chair having a seat, the backrest comprising:

(a) a support structure having a top and a bottom and a central open portion;

(b) a plurality of vertically extending members having a top portion and a bottom portion, said vertically extending members being positioned in the central opening and laterally spaced apart for at least a portion of their height to permit independent movement of adjacent vertically extending members, wherein each of the vertically extending members supports a longitudinal section of at least the lumbar region of a person seated on the chair without engaging a supplemental support member, the vertically extending members are adjustable by raising or lowering one of the top portion or the bottom portion.

13. The backrest of claim 12 wherein the vertically extending members are adjustable for controlling the amount of support provided to the lumbar region of the person.

14. The backrest of claim 12 wherein one of the top portion or the bottom portion is attached directly to the support structure and the other of the top portion or the bottom portion is engagable at a plurality of vertically spaced apart engagement members provided on the support structure.

15. The backrest of claim 13 wherein the vertically extending member has a bottom portion that is vertically adjustable to vary the amount of support provided to the lumbar region of the person.

16. The backrest of claim 15 wherein the bottom portion is engagable at a plurality of vertically spaced apart engagement members provided on a bottom portion of the support structure.

17. The backrest of claim 15 wherein the support structure comprises a frame and a support shell mounted thereon and wherein the vertically extending members are provided on the support shell at one vertical end thereof and wherein the engagement members are provided on the frame.

18. The backrest of claim 12 wherein the support structure and the vertically extending members are formed integrally.

* * * * *